US010577984B2

(12) United States Patent
Aumann et al.

(10) Patent No.: US 10,577,984 B2
(45) Date of Patent: Mar. 3, 2020

(54) FUNCTIONAL SYNERGIES OF THERMODYNAMIC CYCLES AND HEAT SOURCES

(71) Applicant: ORCAN ENERGY AG, Munich (DE)

(72) Inventors: Richard Aumann, Munich (DE); Nicolas Restrepo, Munich (DE); Andreas Schuster, Tussenhausen (DE); Andreas Sichert, Munich (DE)

(73) Assignee: ORCAN ENERGY AG, München (DE)

( * ) Notice: Subject to any disclaimer, the term of this patent is extended or adjusted under 35 U.S.C. 154(b) by 0 days.

(21) Appl. No.: 15/767,930

(22) PCT Filed: Oct. 6, 2016

(86) PCT No.: PCT/EP2016/073846
§ 371 (c)(1),
(2) Date: Apr. 12, 2018

(87) PCT Pub. No.: WO2017/067790
PCT Pub. Date: Apr. 27, 2017

(65) Prior Publication Data

US 2018/0313234 A1 Nov. 1, 2018

(30) Foreign Application Priority Data

Oct. 21, 2015 (EP) ..... 15190780
Sep. 30, 2016 (EP) ..... 16191660

(51) Int. Cl.
*F01K 15/02* (2006.01)
*F01K 23/10* (2006.01)
(Continued)

(52) U.S. Cl.
CPC ..... *F01K 23/10* (2013.01); *B60H 1/3222* (2013.01); *F01K 13/02* (2013.01); *F01K 15/02* (2013.01);
(Continued)

(58) Field of Classification Search
CPC ..... F01N 5/02; F01N 2240/02; F01K 15/02; F01K 23/065
See application file for complete search history.

(56) References Cited

U.S. PATENT DOCUMENTS

2010/0018207 A1* 1/2010 Juchymenko ..... F01K 23/065 60/670
2010/0326076 A1* 12/2010 Ast ..... F01K 23/04 60/671
(Continued)

FOREIGN PATENT DOCUMENTS

CN 104279031 A 1/2015
CN 104619959 A 5/2015
(Continued)

OTHER PUBLICATIONS

International Search Report for International Patent Application No. PCT/EP2016/073846 dated Dec. 21, 2016.
(Continued)

*Primary Examiner* — Jonathan R Matthias
(74) *Attorney, Agent, or Firm* — Moore & Van Allen PLLC; Henry B. Ward, III

(57) ABSTRACT

The system according to the invention comprises a heat source and a cooling device for discharging heat from the heat source, the cooling device comprising: a heat exchanger/radiator for transferring heat to a surrounding medium, in particular wherein the radiator is an air cooler and the surrounding medium is air; and a thermodynamic cycle device, in particular an ORC device, comprising a
(Continued)

working medium, an evaporator for evaporating the working medium by transferring heat from the heat source to the working medium, an expansion device for generating mechanical energy, and a condenser for condensing the working medium expanded in the expansion device; wherein the cooling device further comprises a condenser coolant circuit for discharging heat out of the condenser of the thermodynamic cycle device via the heat exchanger/radiator. The method according to the invention is suitable for discharging heat from a heat source with a cooling device.

18 Claims, 12 Drawing Sheets

(51) Int. Cl.

| | |
|---|---|
| ***F01K 23/06*** | (2006.01) |
| ***B60H 1/32*** | (2006.01) |
| ***F01K 13/02*** | (2006.01) |
| ***F28F 27/02*** | (2006.01) |
| *F04D 25/04* | (2006.01) |

(52) U.S. Cl.
CPC ..... *F01K 23/065* (2013.01); *F28F 27/02* (2013.01); *F04D 25/04* (2013.01)

(56) References Cited

U.S. PATENT DOCUMENTS

| | | | | |
|---|---|---|---|---|
| 2011/0041505 | A1* | 2/2011 | Kasuya | F01K 23/065 60/660 |
| 2013/0312418 | A1 | 11/2013 | Kardos et al. | |
| 2014/0116051 | A1* | 5/2014 | Enokijima | F01K 23/10 60/660 |
| 2015/0013335 | A1 | 1/2015 | Carstensen et al. | |
| 2015/0252692 | A1 | 9/2015 | Honkatukia et al. | |
| 2015/0276284 | A1 | 10/2015 | Waibel et al. | |

FOREIGN PATENT DOCUMENTS

| | | | |
|---|---|---|---|
| DE | 102012021327 | A1 | 1/2014 |
| DE | 102012022648 | A1 | 5/2014 |
| EP | 2789812 | A1 | 10/2014 |
| WO | 2011128360 | A1 | 10/2011 |

OTHER PUBLICATIONS

Written Opinion for International Patent Application No. PCT/EP2016/073846 dated Dec. 21, 2016.
Chinese Office Action received Oct. 8, 2019, search completed Sep. 24, 2019 relating to Chinese Application No. 2016800754720.

* cited by examiner

FUNCTIONAL SYNERGIES OF THERMODYNAMIC CYCLES AND HEAT SOURCES

FIELD OF THE INVENTION

The invention relates to a system for heat utilization comprising a heat source and a cooling device for removing heat from the heat source, the cooling device comprising: a radiator for transferring heat to a surrounding medium, in particular wherein the radiator is an air cooler and the surrounding medium is air; and a thermodynamic cycle device, particularly an ORC device, having a working medium, an evaporator for evaporating the working medium by transferring heat of the heat source to the working medium, an expansion device for generating mechanical energy, and a condenser for condensing the working medium expanded in the expansion device. Furthermore, the invention relates to a corresponding method for discharging heat from a heat source with a cooling device.

STATE OF THE ART

An economical solution to increase the efficiency of internal combustion engines with great potential, especially in trucks, is the utilization of waste heat of the internal combustion engine with a thermal cycle (for example, with an Organic Rankine cycle system, ORC system). Some of the requirements or given conditions here are low additional costs, small space available, little intervention and influence on the other system. It is therefore useful or necessary to exploit synergies with existing components.

When a power generating process, such as the Organic Rankine Cycle (ORC), is operated in the environment of an internal combustion engine, still both the direct integration of the generated energy as mechanical performance in the system (e.g. the expansion engine of the ORC system can support the drive of combustion engine), as well as their provision for ancillaries is often advantageous because conversion of mechanical energy into electrical energy results in conversion losses. In addition, costs are dispensed with due to the saved motors for the drive or generators for the outlet and the compactness can be increased, both of which are critical factors for the integration of a power generating process in the said environment. In addition, the expansion machine can also drive a generator, wherein the electrical energy generated thereby can be used for driving one or more components in the environment of the internal combustion engine. In this context, the hybridization should also be mentioned, i.e. the direct or indirect use of the generated electrical energy in the drive train of the internal combustion engine. For example, one or more electric motors powered by the generated electrical energy may be provided in a truck for driving one or more drive shafts.

DESCRIPTION OF THE INVENTION

The object of the invention is to provide synergies in the use of heat from heat sources.

The object is achieved by a system according to claim 1.

The system according to the invention comprises a heat source and a cooling device for discharging heat from the heat source, the cooling device comprising: a radiator for transferring heat to a surrounding medium, in particular wherein the radiator is an air cooler and the surrounding medium is air; and a thermodynamic cycle device, in particular an ORC device, having a working medium, an evaporator for evaporating the working medium by transferring heat from the heat source to the working medium, an expansion device for generating mechanical energy, and a condenser for condensing the working medium expanded in the expansion device; wherein the cooling device further comprises a condenser coolant circuit for discharging heat from the condenser of the thermodynamic cycle device via the radiator. This embodiment of the system according to the invention allows the shared use of the existing radiator for the heat discharge from the condenser of the thermodynamic cycle device, in particular for the heat discharge from the ORC capacitor. The cooling fluid may in particular be or comprise water, preferably with a proportion of antifreeze. The heat source may be, for example, an internal combustion engine.

The system according to the invention may be further developed in that the cooling device further comprises a heat source coolant circuit, wherein a first branch of the heat source coolant circuit leads through the evaporator for transferring heat to the working fluid. In this way, the heat in the cooling circuit of the heat source can be introduced into the thermodynamic cycle.

Another development is that the heat source coolant circuit in the direction of flow of a cooling fluid upstream of the evaporator comprises a first branch-off into a second branch of the heat source coolant circuit for bypassing the evaporator and a merging of the second branch with the first branch downstream the evaporator, wherein the second branch comprises a first valve, preferably a controlled valve. In this embodiment, the exit temperature of the cooling fluid (in particular engine cooling water) is set to a higher value via the valve than in the usual operation according to the prior art. The increase in temperature results in a higher power of the thermodynamic cycle.

Another development is that the heat source coolant circuit in the flow direction of the cooling fluid upstream the evaporator comprises a second branch-off into a third branch of the heat source coolant circuit, and wherein the third branch is adapted to guide cooling fluid through the radiator and back into the first branch, wherein the second branch-off preferably comprises a second valve, in particular a three-way valve. In this way, an emergency operation capability of the system is provided. Such emergency operation capability may be required if the temperature of the heat source is increased due to failure of the thermodynamic cycle or due to insufficient heat absorption by the thermodynamic cycle. If the heat transfer capacity of the radiator is insufficient and/or if no or insufficient cooling of the cooling fluid takes place in the evaporator, cooling fluid can be passed directly to the radiator via the second valve. As a result, the temperature of the cooling fluid supplied to the radiator increases, the logarithmic temperature difference increases, and more heat is transferred.

According to another embodiment, the heat source coolant circuit in the flow direction of the cooling fluid downstream of the evaporator may comprise a third branch-off into a fourth branch of the heat source coolant circuit, the fourth branch being adapted to guide cooling fluid through the radiator and back into the first branch, wherein the third branch preferably comprises a third valve, in particular a three-way valve, wherein, in combination with the preceding development, a merging of the fourth branch into the third branch is provided. These advantages of this development are analogous to those of the previous development, it is only branched off after the evaporator, so that a more moderate heat extraction than upstream the evaporator is possible. When combining both developments, both valves can be opened simultaneously.

Another development is that the heat source coolant circuit in the flow direction of the cooling fluid upstream the radiator comprises a merging of the third and/or fourth branch with the condenser coolant circuit. In this way, a simple interconnection of the heat source coolant circuit with the condenser coolant circuit is provided. A disadvantage, however, is that the condenser of the thermodynamic cycle device is also flowed through by relatively hot cooling fluid, which has a negative effect on the performance of the expansion device.

In another embodiment, the radiator may include an inlet collector, an outlet collector, and intermediate channels interconnecting respective opposite portions of the inlet collector and the outlet collector, and wherein an inlet of the condenser coolant circuit into the inlet collector and an inlet of the third and/or fourth branch of the heat source coolant circuit into the inlet collector are spaced apart from each other, in particular at respective end portions of the inlet collector, and wherein an outlet of the condenser coolant circuit out of the outlet collector and an outlet of the third and/or fourth branch of the heat source coolant circuit are spaced from each other and are arranged particularly at respective end portions of the outlet collector, wherein the inlet and outlet of the condenser coolant circuit and the heat source coolant circuit are arranged at respectively opposite areas of the inlet collector and the outlet collector.

In this way, a division of the existing radiator surface into a high-temperature region (cooling fluid of the heat source) and a low-temperature region (cooling fluid for the condenser of the thermodynamic cycle device) is made possible. Thus, a possibly low temperature can be provided to the capacitor and the discharge of excess heat of the cooling fluid of the heat source to a high temperature level take place, which has a positive effect on the heat discharge through the radiator to the environment. The distribution of the mass flows in partial mass flows to the terminals of the inlet collector and thus also through the radiator surface is preferably carried out via the second and/or third valve. Adjusting the proportions of the hot or cold radiator surface takes place automatically in this interconnection depending on the partial mass flows.

Another development is that the cooling device further comprises at least one heat exchanger for transferring heat in exhaust gas of the heat source to the heat source coolant circuit. Thus, the heat in the exhaust gas of the heat source can be utilized. In addition, the sound-absorbing property of an exhaust gas heat exchanger can be used to reduce the actual muffler or to completely replace it. Other sources of heat that can be used are other heat flows bound to mass flows, such as e.g. hot gas mass flows.

According to another embodiment, the system further comprises a generator with which the mechanical energy generated by the expansion device is convertible into electrical energy. The generated electrical energy can be used to operate electrical components in the system or to be fed into an electrical grid.

Another development is that mechanical energy generated by the expansion device can be used via a respective electrical, mechanical or hydraulic coupling for (a) driving a fan of the condenser and/or a fan of the radiator; and/or (b) driving a circulation pump in the heat source coolant circuit and/or a feed pump of the thermodynamic cycle device and/or a circulation pump in the condenser coolant circuit and/or a water pump and/or a hydraulic pump and/or an oil pump; and/or (c) driving a generator and/or starter of the system; and/or (d) driving a refrigeration compressor of an air conditioner; and or (e) coupling the mechanical energy generated by the expansion device in a drive train of an internal combustion engine as a heat source, in particular directly to a drive shaft. This will provide further synergies in the system.

According to another embodiment, a partial flow of the vaporized working medium can be used by means of a further expansion machine for driving a fan of the condenser and/or a fan of the radiator. This minimizes conversion losses.

Another development is that heat from condensed working medium and/or from the heat source coolant circuit can be decoupled for feeding into a further heat sink. Thus, heat can be coupled out, for example, in heating networks, particularly advantageous are low-temperature heat sinks, such as dryers, floor or surface heating or air heaters.

The object underlying the invention is further achieved by an inventive method according to claim 13.

The method according to the invention is suitable for discharging waste heat from a heat source with a cooling device, wherein the cooling device comprises a radiator, a thermodynamic cycle device, in particular an ORC device, with a working medium, an evaporator, an expansion device and a condenser as well as a condenser coolant circuit, and wherein the method comprises the steps of: transferring heat to a surrounding medium with the radiator, wherein in particular the radiator is an air cooler and the surrounding medium is air; vaporizing the working medium with the evaporator by transferring waste heat from the heat source to the working medium; generating mechanical energy with the expansion device; and condensing the working medium expanded in the expansion device with the condenser; and the method is characterized by discharging heat from the condenser of the thermodynamic cycle device via the radiator.

The advantages of the method according to the invention and its developments correspond—unless otherwise stated—to those of the device according to the invention.

According to a development of the method according to the invention, the following further steps are carried out: guiding a first branch of a heat source coolant circuit through the evaporator for transferring heat to the working medium; and first branching-off of a cooling fluid in the heat source coolant circuit upstream of the evaporator into a second branch of the heat source coolant circuit for bypassing the evaporator and merging the second branch with the first branch downstream the evaporator.

Another development is that the following further steps are carried out: second branching-off of the cooling fluid upstream of the evaporator into a third branch of the heat source coolant circuit, the third branch guiding cooling fluid through the radiator and back into the first branch; and/or third branching-off of the cooling fluid downstream of the evaporator into a fourth branch of the heat source coolant circuit, the fourth branch carrying cooling fluid through the radiator and back into the first branch; wherein the radiator has an inlet collector, an outlet collector, and intermediate channels interconnecting respective opposite regions of the inlet collector and the outlet collector, and wherein an inlet of the condenser coolant circuit into the inlet collector and an inlet of the third and/or fourth branch of the heat source coolant circuit into the inlet collector are spaced from each other, in particular at respective end portions of the inlet collector, and wherein an outlet of the condenser coolant circuit from the outlet collector and an outlet of the third and/or fourth branch of the heat source coolant circuit from the outlet collector are spaced from each other in particular at respective end portions of the outlet collector, wherein the inlet and outlet of the condenser coolant circuit and the heat source coolant circuit are arranged at respectively opposite areas of the inlet collector or the outlet collector.

The invention further provides a cooling device and a corresponding method for operating the cooling device.

The cooling device according to the invention comprises: a first cooling fluid circuit, a second cooling fluid circuit and a radiator having an inlet collector, an outlet collector, and intermediate channels connecting respective opposite regions of the inlet collector and outlet collector, wherein an inlet of the first cooling fluid circuit into the inlet collector and an inlet of the second cooling fluid circuit are spaced from one another in the inlet collector, in particular at respective end portions of the inlet collector, and wherein an outlet of the first cooling fluid circuit out of the outlet collector and an outlet of the second cooling fluid circuit out of the outlet collector are spaced from each other, particularly at respective end portions of the outlet collector, wherein the inlet and outlet of the first cooling fluid circuit and the second cooling fluid circuit are arranged at respective opposite regions of the inlet collector and outlet collector. Preferably, a controllable valve is provided in the first cooling fluid circuit and/or a controllable valve is provided in the second cooling fluid circuit. The radiator may preferably transfer heat from the first and second cooling fluid circuits to a cooling medium, wherein the cooling medium may include, for example, water or air.

The inventive method for operating the cooling device according to the invention comprises performing the following steps: guiding a first cooling fluid in the first cooling fluid circuit into the inlet of the first cooling fluid circuit into the inlet collector of the radiator; guiding a second cooling fluid in the second cooling fluid circuit into the inlet of the second cooling fluid circuit into the inlet collector of the radiator; guiding the first cooling fluid out of the outlet of the first cooling fluid circuit from the radiator; and guiding the second cooling fluid out of the outlet of the first cooling fluid circuit from the radiator. In particular, the first and second cooling fluids have the same composition.

In this way, a division of the existing radiator surface into a high-temperature region (cooling fluid of the first cooling fluid circuit) and a low-temperature region (cooling fluid of the second cooling fluid circuit) is made possible. The distribution of the mass flows in partial mass flows to the terminals of the inlet collector (i.e. the respective inlets of the first and second cooling fluid circuit) and thus the distribution of (partial) mass flows through the radiator surface is preferably carried out via one or more valves in the first and/or second cooling fluid circuit. The adaptation of the proportions of the hot or cold radiator surface takes place independently as a function of the partial mass flows.

The said developments can be used individually or combined in a suitable way as claimed.

Further features and exemplary embodiments and advantages of the present invention will be explained in more detail with reference to the drawings. It is understood that the embodiments do not exhaust the scope of the present invention. It is further understood that some or all of the features described below may be combined with each other in other ways.

DRAWINGS

EMBODIMENTS

Figure 1:
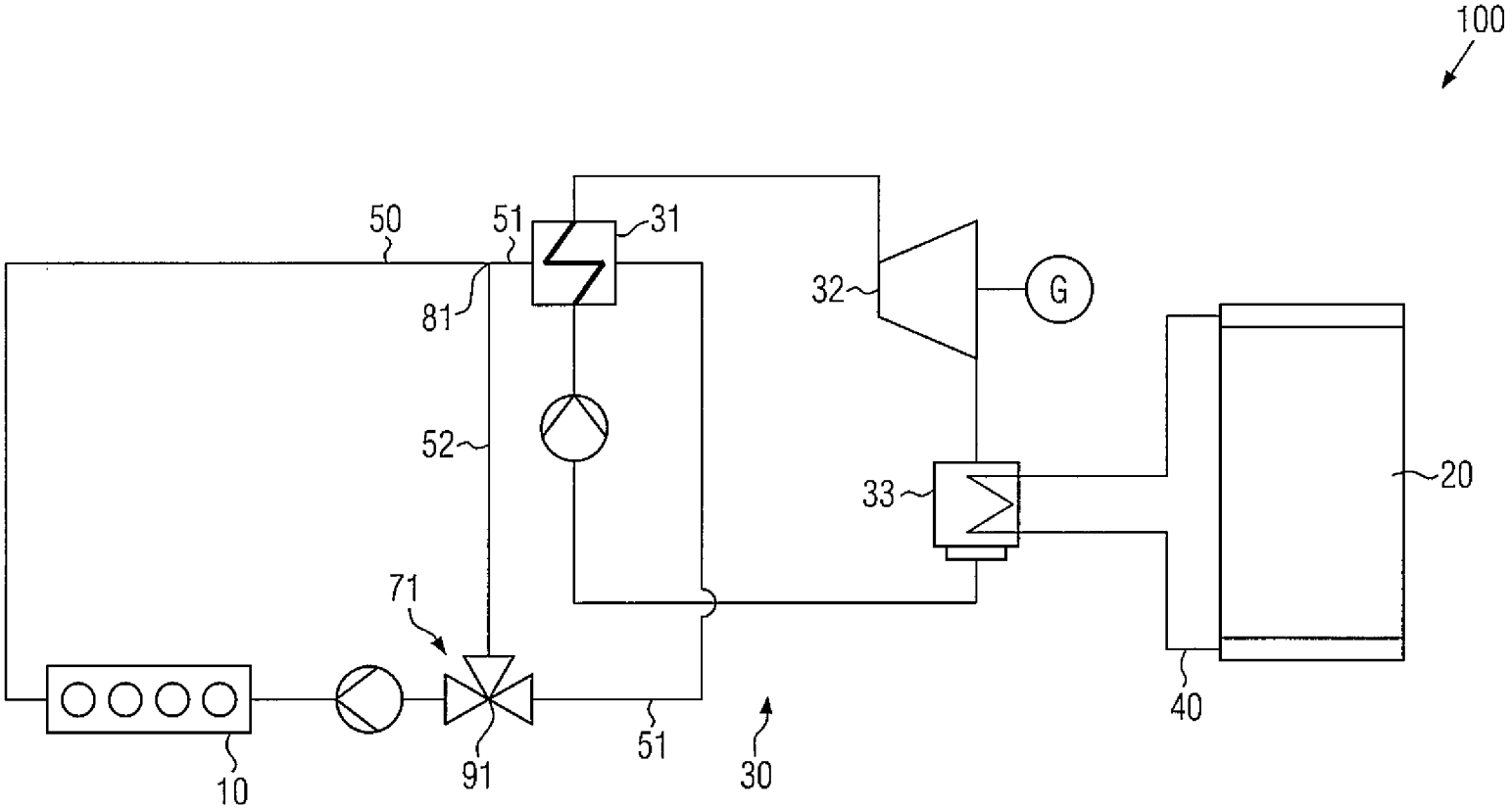
FIG. 1 shows a first embodiment of the system according to the invention.

One way to utilize synergies with already existing components such as internal combustion engines as a heat source for the utilization of heat of a heat source by means of a thermodynamic cycle device—such as for instance an ORC-system—is the shared use of an existing radiator for heat discharge from the ORC capacitor. Thus, in moderate load operating conditions, e.g. at moderate outdoor temperatures, all heat can be passed through the ORC system and released into the radiator in the environment. Moderate load operation takes the largest amount of time in most cooling systems.

The ORC system is designed to receive all the heat from the heat source during nominal operation (outside temperature equal to the nominal temperature). Conversely, this means that it cannot absorb all the heat in the maximum load points (high outside temperatures). Since the heat extracted from the ORC is of lower temperature than the cooling fluid, the heat discharge deteriorates due to the decreasing temperature difference from the environment $\Delta T_{log}$:

$$\dot{Q}=UA\cdot\Delta T_{log}$$

The logarithmic temperature difference is defined as $$\Delta T_{log}=\frac{\Delta T_1-\Delta T_2}{\ln(\Delta T_1/\Delta T_2)}$$

wherein the temperature differences of the media (cooling liquid and air) are formed before the heat exchange ($\Delta TI_1$) and after the heat exchange ($\Delta TI_2$).

If the logarithmic temperature difference decreases, the required area increases with the same amount of heat, which, however, cannot usually be implemented for reasons of space. The problem is exacerbated when other heat sources are involved, e.g. the heat of an ORC system, which uses exhaust heat, for example. Another problem is when heat recovery is to be added as part of a retrofit. Then the radiator geometry is already given. Another problem is when due to cost, the size of a heat exchanger should be kept as compact as possible.

For a simple and fast implementation of the integration of an ORC, for example in a vehicle, it is necessary to minimize the design intervention and to limit the influence on the engine while ensuring a high efficiency of the ORC process.

Regarding the advantages of the waste heat utilization from the cooling water of the internal combustion engine with an ORC device and using the energy obtained in the drive device with the ORC system, the large efficiency increase of the engine in the range of several percent, cost savings and space savings through fewer components compared to ORC-Systems that use exhaust heat have to be mentioned. A disadvantage is first in the first embodiment of the invention that the radiator at maximum load of the engine cannot ensure the heat discharge of the OCR in general, which however is remedied or at least mitigated in the other embodiments.

In the embodiments described below, only water is used as cooling fluid (cooling water) by way of example. Furthermore, the radiator is provided by way of example only as an air cooler, so that waste heat is transferred to air. According to the invention, however, another medium (such as water) can absorb the heat discharged in the radiator.

FIG. 1 shows a first embodiment of the system according to the invention in the form of a drive system.

The drive system 100 according to the invention comprises in this embodiment an internal combustion engine 10 and a cooling device for removing waste heat from the internal combustion engine, the cooling device comprising: an air cooler 20 for transferring heat to air; and an ORC device 30 with a working medium, an evaporator 31 for evaporating the working medium by transferring waste heat of the internal combustion engine 10 to the working medium, an expansion device 32 for generating mechanical energy (which is converted here by way of example via a generator G into electrical energy) and a condenser 33 for condensing the working medium expanded in the expansion device 32; wherein the cooling device further comprises a condenser coolant circuit 40 for removing heat from the condenser 33 of the thermodynamic cycle device via the radiator 20. The cooling apparatus further includes an engine cooling fluid circuit 50, wherein a first branch 51 of the engine cooling fluid circuit 50 passes through the evaporator 31 for transferring heat to the working fluid. The engine cooling fluid circuit comprises, in the flow direction of the cooling water upstream of the evaporator, a first branch-off 81 into a second branch 52 of the engine cooling fluid circuit 50 for bypassing the evaporator 31 and a merging 91 of the second branch 52 with the first branch 51 downstream of the evaporator 31, wherein the second branch 52 comprises a controlled valve 71, for example with a thermostat.

This is a basic interconnection, and it allows the use of energy from the engine cooling water. In one example, the outlet temperature of the engine cooling water (MKW) via the controlled valve (in particular thermostatic valve) 71 is driven to about 110° C. By default, the MKW outlet temperature is lower, in the range of 80° C. The increase results in a higher performance of the ORC process. In an alternative embodiment, instead of the generator G, the coupling of energy can also be done directly (mechanically or hydraulically), as with all subsequent interconnections also.

This results in the following problem during operation: The system 100 has no capability of an emergency operation in case of ORC failure or insufficient heat discharge. When the ORC process 30 is at the limit of its heat absorption or is not in operation, the water circuit 50 heats up and the engine 10 overheats or is downshifted by an engine control.

Figure 2:
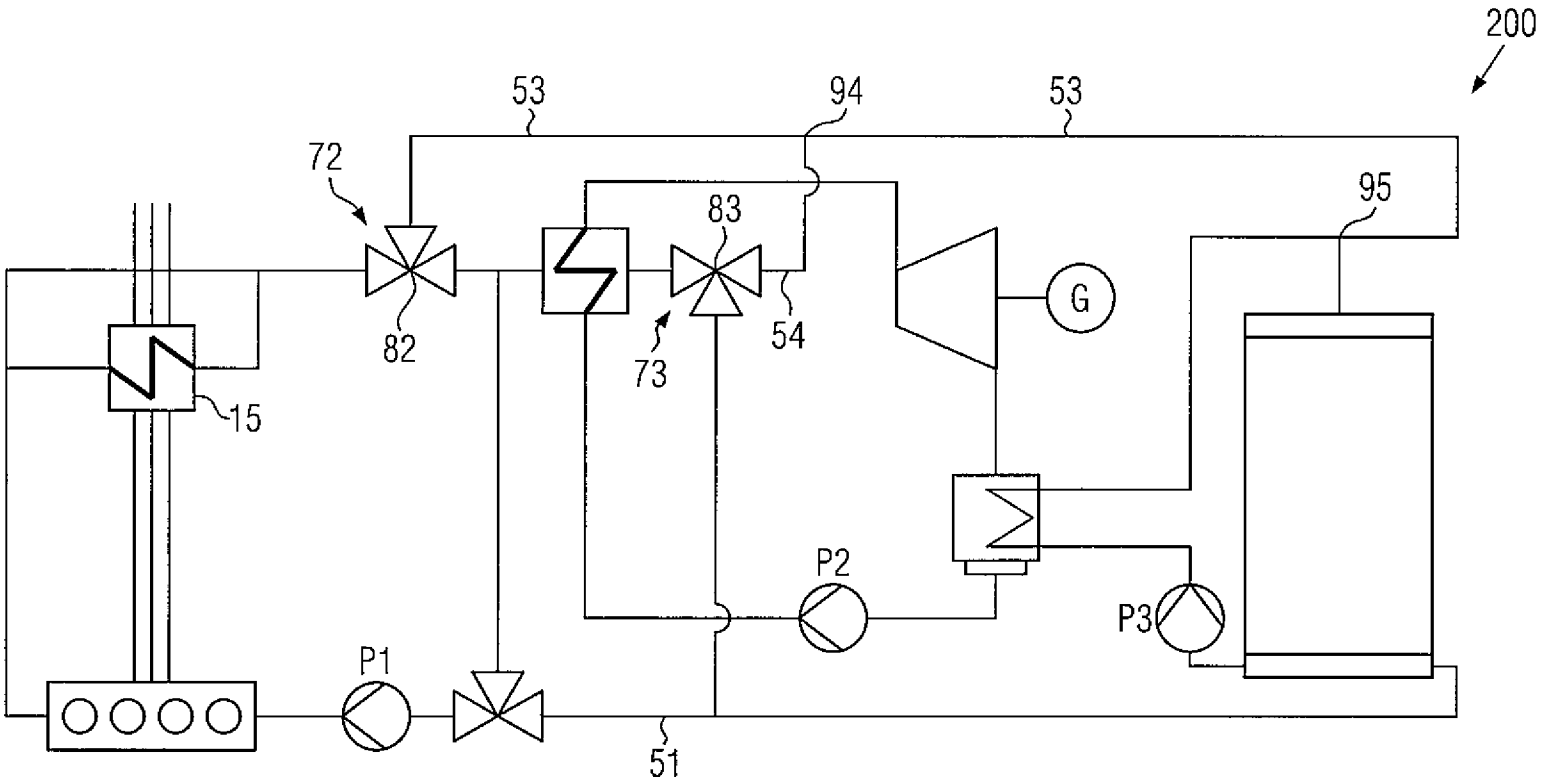
FIG. 2 shows a second embodiment of the system according to the invention.

FIG. 2 shows a second embodiment of the drive system according to the invention. The same reference numerals designate here the same components as in FIG. 1. In the following, only the additional components will be described.

Compared to the first embodiment, in the second embodiment of the drive system 200 a coupling of heat from the exhaust gas of the engine 10 via an exhaust gas heat exchanger 15 into the engine cooling fluid circuit 50 is additionally provided. The engine cooling fluid circuit 50 includes, in the flow direction of the cooling fluid upstream of the evaporator 31, a second branch-off 82 into a third branch 53 of the engine cooling fluid circuit 50, the third branch 53 being configured to provide cooling fluid through the radiator 20 and back into the first branch 51, wherein the second branch-off 82 comprises a second valve 72, for example a three-way valve 72. If the heat transfer capacity of the radiator 20 is insufficient, water can be passed directly to the radiator 20 via the second valve 72. The engine cooling fluid circuit 50 has, in the flow direction of the cooling fluid downstream of the evaporator 31, a third branch-off 83 into a fourth branch 54 of the engine cooling fluid circuit 50, the fourth branch 54 guiding cooling water through the radiator 20 and back into the first branch 51, wherein the third branch-off 83 has a third valve 73, in particular a three-way valve 73, wherein a merging 94 of the fourth branch 54 is provided into the third branch 53. The engine cooling fluid circuit 50 comprises in the flow direction of the cooling fluid in front of the radiator 20 a merging 95 of the third and fourth branches 53, 54 with the condenser coolant circuit 40.

An emergency operation capability is given via the 3-way valves 72 and 73, respectively. During operation of the ORC, the average temperature at the inlet of the radiator 20 decreases (due to the merging 95 of the engine cooling fluid circuit 50 and the condenser coolant circuit 40) which adversely affects the heat transfer capacity which is determined by the logarithmic temperature difference between the heat-absorbing and the heat-discharging medium. If the heat transfer capacity of the radiator 20 is insufficient and/or if there is no or insufficient cooling of the engine cooling water in the evaporator 31, then engine cooling water is fed directly to the radiator 20 via one of the two valves 72 or 73 or by the actuation of both valves. As a result, the temperature of the water supplied to the radiator 20 increases, the logarithmic temperature difference increases, and more heat is transmitted. The disadvantage, however, is that the ORC is also flown through by relatively hot water, which has a negative effect on the electrical power.

Figure 3:
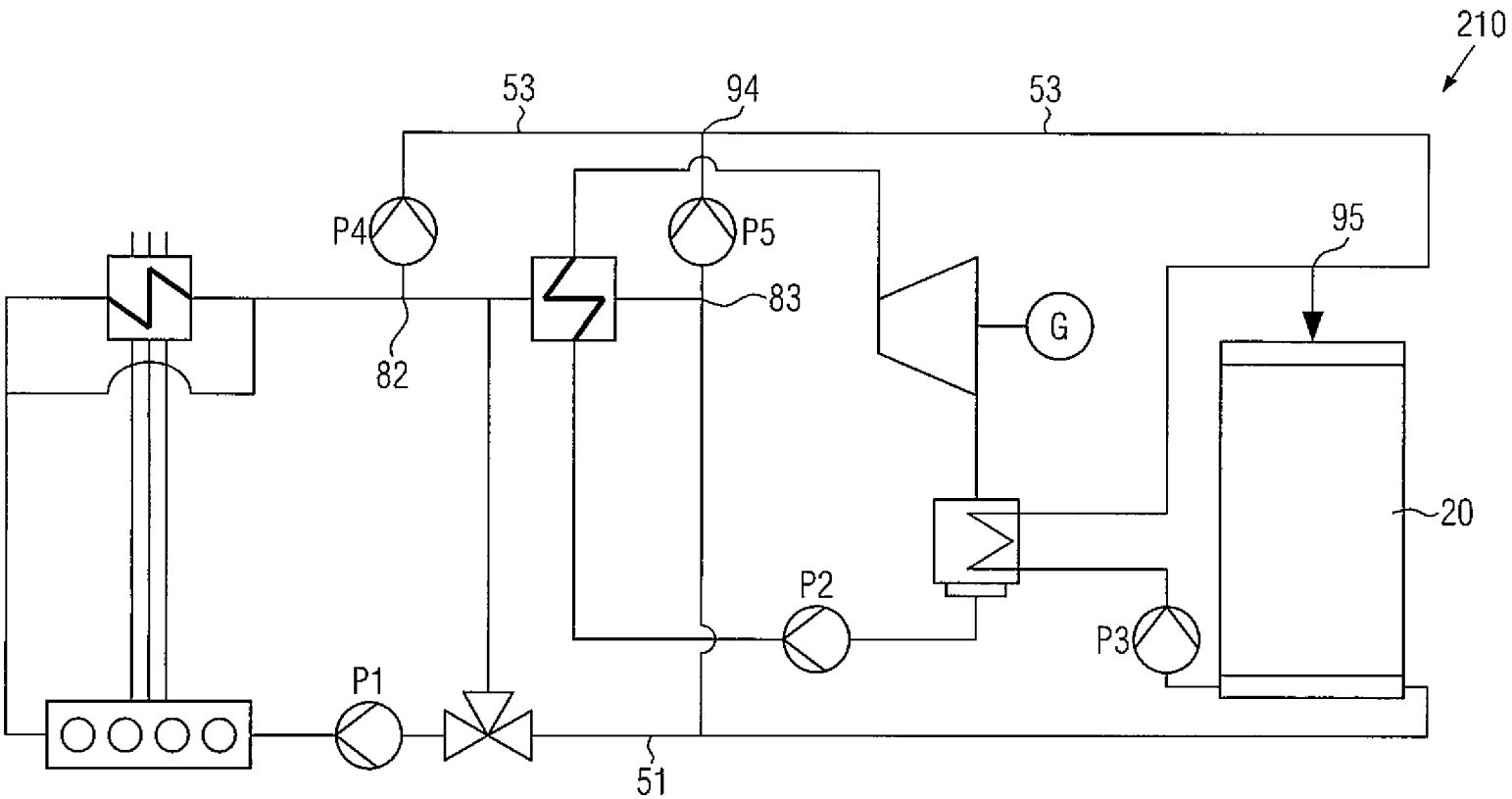
FIG. 3 shows a modified version of the second embodiment of the system according to the invention.

FIG. 3 shows an embodiment 210 of the system according to the invention which is modified with respect to FIG. 2. Instead of the second valve 72 a pump P4 is provided and instead of the third valve 73 a pump P5 is provided. Both pumps serve to control the mass flow to the radiator 20 and are thus controllable pumps.

Furthermore, the pump P3 can be made adjustable. This can be regulated depending on the pump P4, the pump P5 or the corresponding 3-way valve. The aim of this measure is to improve the heat discharge of the heat exchanger 20 and/or to minimize the auxiliary energy expenditure for the pumps.

When the volume flow of the pump P3 is reduced after the connection in FIG. 3, the inlet temperature in the WÜ20 and thus the temperature difference to the cooling medium (e.g., ambient air) increases. This allows more heat to be transferred.

If, after the connection in FIG. 3, more fluid is conducted via the line 53 for cooling, a large amount of heat transfer surface is required for the high-temperature component. In this case, the pump P3 can be downshifted, thus the total volume flow over the heat exchanger surface is reduced and, as a result, the pressure difference that must be applied by the pumps P3 to P5 is reduced. Conversely, therefore, much space is available for the ORC capacitor if little fluid flows over line 53. This is for instance the case if the entire heat or a majority of the heat can be discharged through the ORC.

This ensures a critical function of the process (ensuring area for high-temperature cooling) and achieves faster and more efficient control. The control can be realized, for example, by maps or parametric tables being stored in the plant control that control the speed of the pump P3.

In the extreme case that the high-temperature heat discharge is to be maximized, the ORC process including the pump P3 is switched off. In order to prevent a partial flow from bypassing the radiator 20, a return stop may be provided upstream the pump P3.

Figure 4:
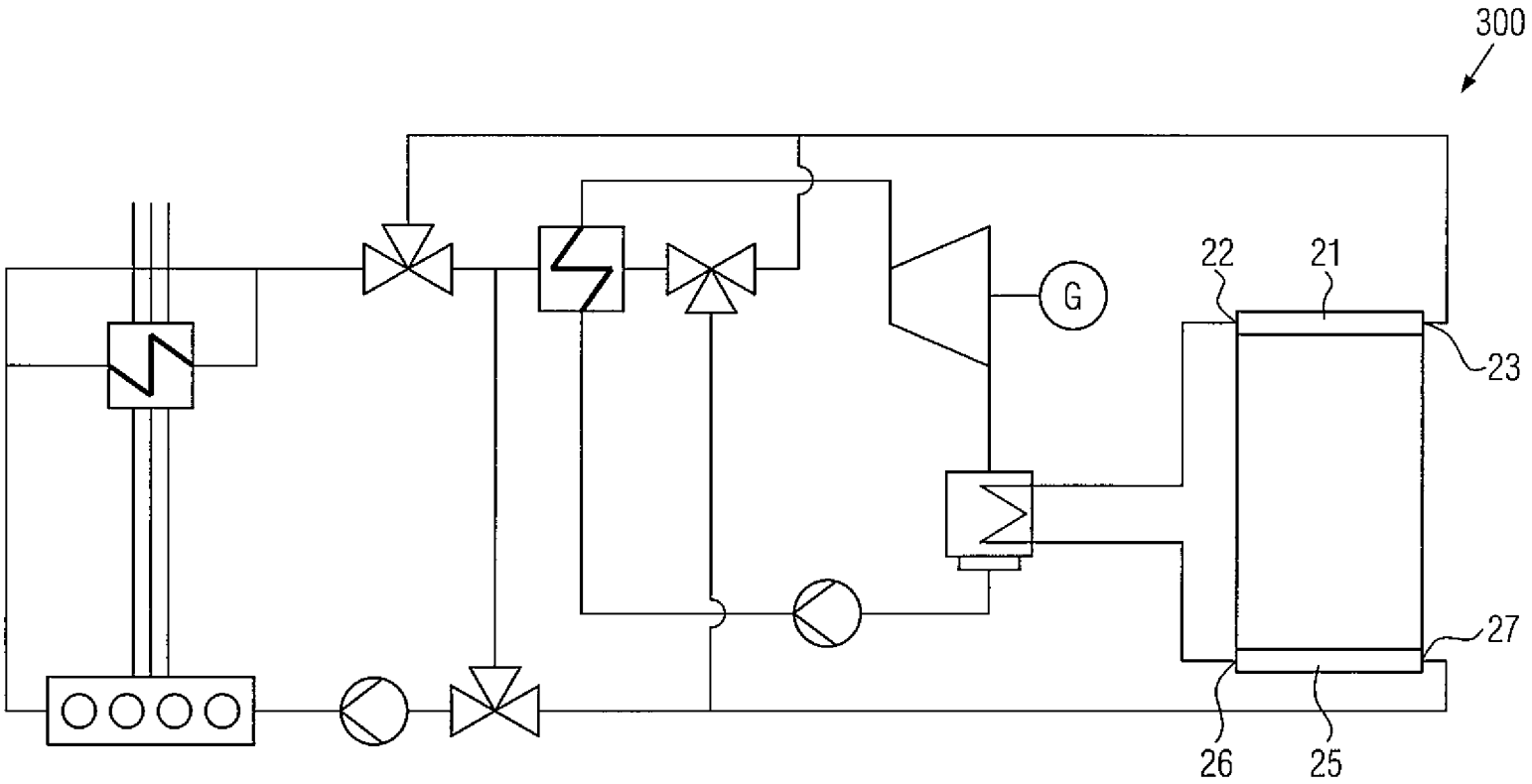
FIG. 4 shows a third embodiment of the system according to the invention.

FIG. 4 shows a third embodiment of the drive system according to the invention. The same reference numerals designate the same components as in FIGS. 1 and 2. Only the additional components will be described below.

According to the third embodiment of the drive system 300 according to the invention, the radiator 20 has an inlet collector 21, an outlet collector 25, and has intermediate channels connecting respective opposite portions of the inlet collector 21 and the outlet collector 25, one inlet 22 of the condenser coolant circuit 40 being arranged in the inlet collector 21 and an inlet 23 of the third branch 53 of the engine cooling fluid circuit 50 in the inlet collector 21 at respective end portions of the inlet collector 21, and wherein an outlet 26 of the condenser coolant circuit 40 from the outlet collector 25 and an outlet 27 of third branch 53 of the engine cooling fluid circuit 50 from the outlet collector 25 are disposed at respective end portions of the outlet manifold 25, wherein the inlet 22, 23 and outlet 26, 27 of the condenser coolant circuit 40 and the engine cooling fluid circuit 50 are arranged at respectively opposite areas of the inlet collector 21 and the outlet collector 25.

Thus, a distribution of the existing radiator surface in a high temperature range (engine cooling water, MKW) and a low temperature range (return to the ORC capacitor) takes place. Depending on the operating point, part of the MKW mass flow can be passed through the ORC 30 and a part cooled directly against air, as described for the second embodiment. This makes it possible to separate the two mass flows, and in this way the ORC condenser can be provided with a possibly low temperature and the discharge of excess heat can be done at a high temperature level, which is beneficial to the performance of a radiator and also has a positive effect on the auxiliary energy requirement for discharging the heat to the environment.

The third embodiment provides a solution to realize in the simplest possible way a division of the two partial flows on the surface of the radiator and advantageously adjust this distribution depending on the operating state. The requirements are that most of the heat is guided through the ORC to maximize the efficiency of the overall system. Furthermore, it is particularly advantageous to use the lowest temperature for cooling the capacitor in order to ensure a higher efficiency of the ORC process. In addition, suitable return temperatures for the engine must be maintained. Although this would be realized by structurally or hydraulically separate radiators, but then the surfaces available for the respective mass flows are fixed, which, however, does not fit to different load points.

The distribution of the mass flow in the branch-off 82 and/or 83 takes place by means of the valve 72 and/or 73. This passes depending on the temperature or another characteristic value a partial flow of the MKW to the radiator 20. The temperature limit depends on whether the variant with valve 72 or 73 is present. For example, upon reaching a maximum cooling water temperature, the valve 72 would switch the flow toward the radiator 20 and bypass the ORC. The valve 73 directs the cooling water in the direction of the radiator 20 when no required cooling is achieved.

Figure 5:
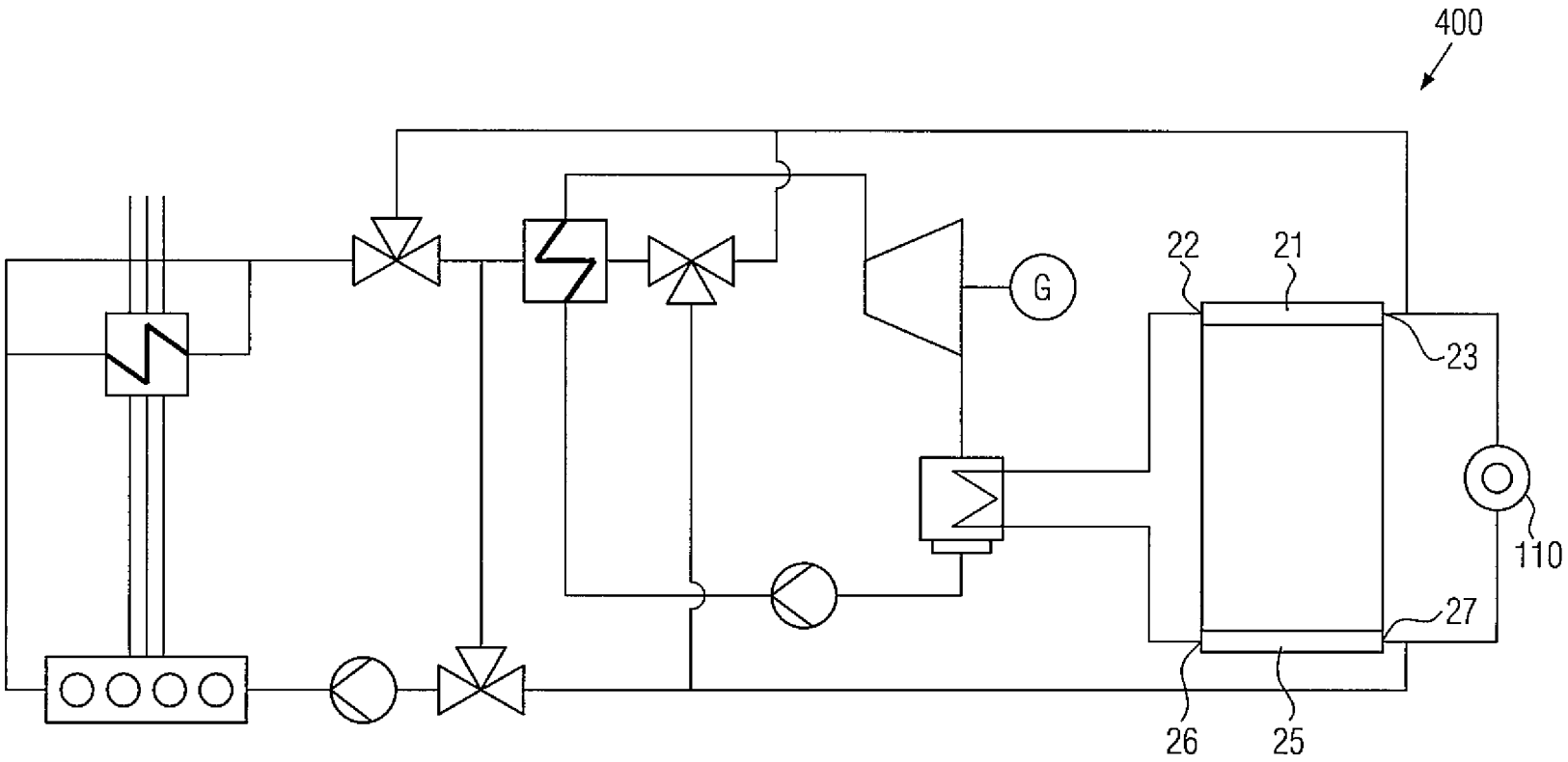
FIG. 5 shows a fourth embodiment of the system according to the invention.

FIG. 5 shows a fourth embodiment of the drive system according to the invention. The same reference numerals designate here the same components as in FIGS. 1 to 3. Only the additional components will be described below.

According to the fourth embodiment 400 of the drive system according to the invention, a further branch-off is provided upstream the radiator 20 in relation to the third embodiment 300 in order to guide hot cooling fluid over a heat sink 110 to use part of the heat otherwise, for example for heating purposes.

Figure 6:
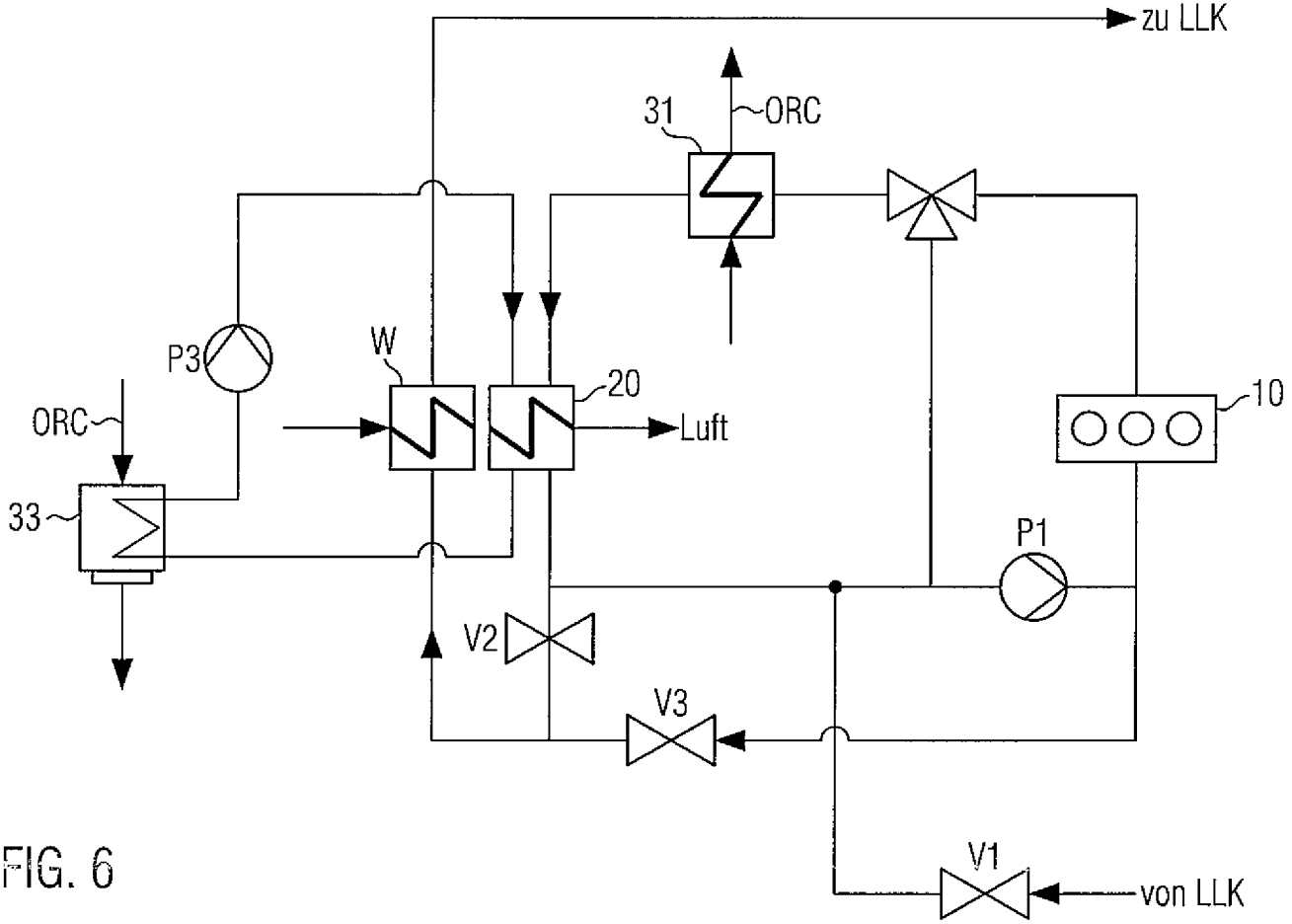
FIG. 6 shows a fifth embodiment of the system according to the invention.
Figure 7:
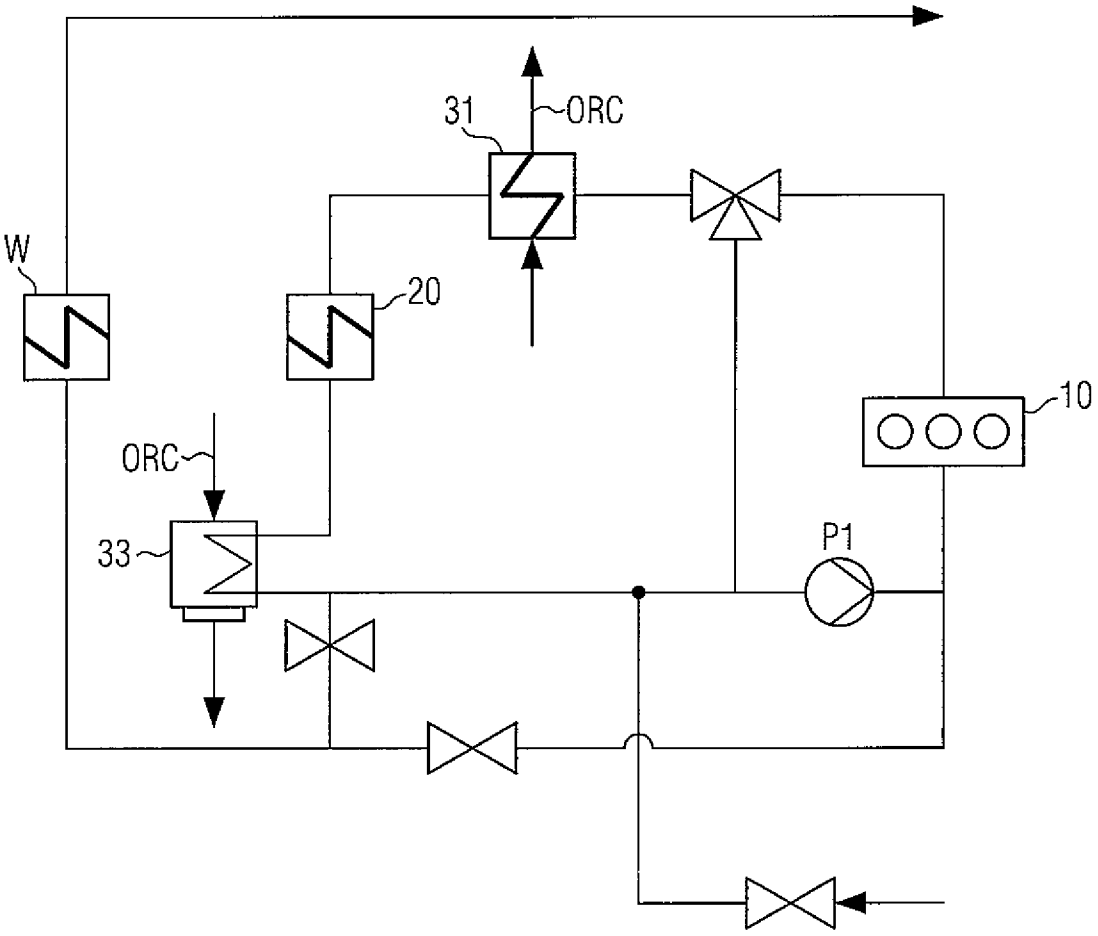
FIG. 7 shows a sixth embodiment of the system according to the invention.

In the fifth and sixth embodiment according to FIGS. 6 and 7, the interconnection according to the invention can be found, extended by the integration of a further cooling circuit at a further temperature level (e.g. cooling circuit for the charge air cooling, LLK) with a heat exchanger W (heat discharge of the charge air cooling circuit), which analog to the radiator 20 cools a fluid (e.g. charge air cooling medium). The heat exchanger W can be connected in series with the heat exchanger 20 on the air side (FIG. 6), and the cooling air or another cooling medium can first be passed through the heat exchanger W and then through the heat exchanger 20. Likewise, a parallel flow is possible (FIG. 7).

The ORC circuit is not shown here for simplicity, a connection with the ORC circuit is only hinted at in this variant.

In the sixth embodiment of FIG. 7, it is possible to serially connect the ORC condenser and the radiator 20 on the water side. The radiator 20 then cools the entire mass flow. When the engine is still warming up, no mass flow will flow towards the evaporator. At partial load, little mass flow flows in the direction of the evaporator, and an oversized radiator is then available there. This can provide the ORC capacitor with a low temperature.

Although this results in a lower maximum available flow through the ORC capacitor, however this can be overcompensated by the lower inlet temperature, so that benefits prevail.

Another advantage is that only one pump is needed to flow through the condenser and the radiator 20.

Figure 8:
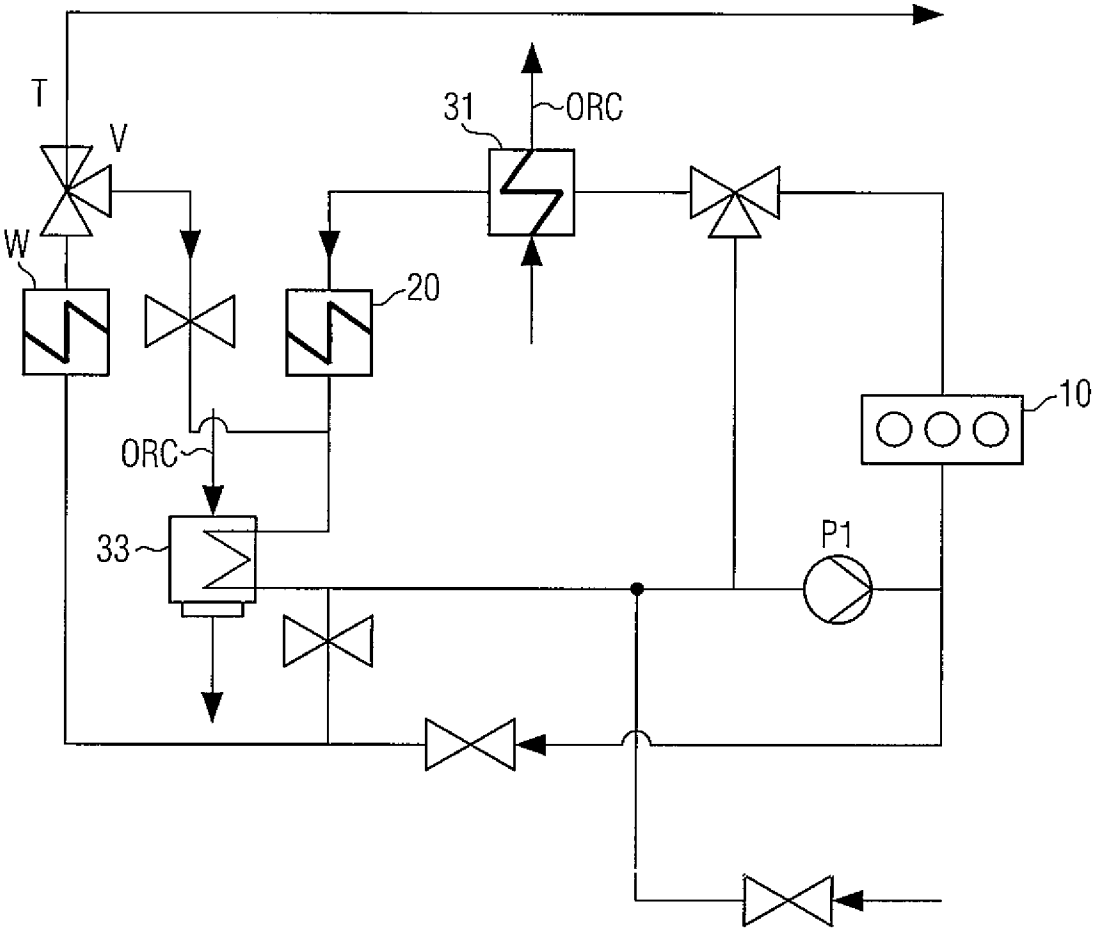
FIG. 8 shows a seventh embodiment of the system according to the invention.

In some operating conditions, not the entire surface of the heat exchanger W is now required for cooling the further cooling circuit. Then the area reserve of the heat exchanger W for the cooling of the ORC circuit can be used. This is made possible by the interconnection shown below in the seventh embodiment of FIG. 8. The control may be e.g. conducted as a function of the outlet temperature T of heat exchanger W. In the event that for the ORC cooling additional surface of heat exchanger W is needed AND an area reserve exists in the heat exchanger W for this operating state, a valve opens (e.g. as shown, a 3-way valve) or another device that allows such liquid allocation, such as also a pump. As a result, a partial flow of the cold additional cooling circuit is passed in the direction of ORC condenser. After passing through the condenser, the partial flow upstream of the heat exchanger W is fed again in order not to negatively influence the temperature of the further cooling circuit.

Analogously, further circuits with further temperatures can also be integrated (for example, the cooling circuit for the air conditioning in the vehicle).

Figure 9:
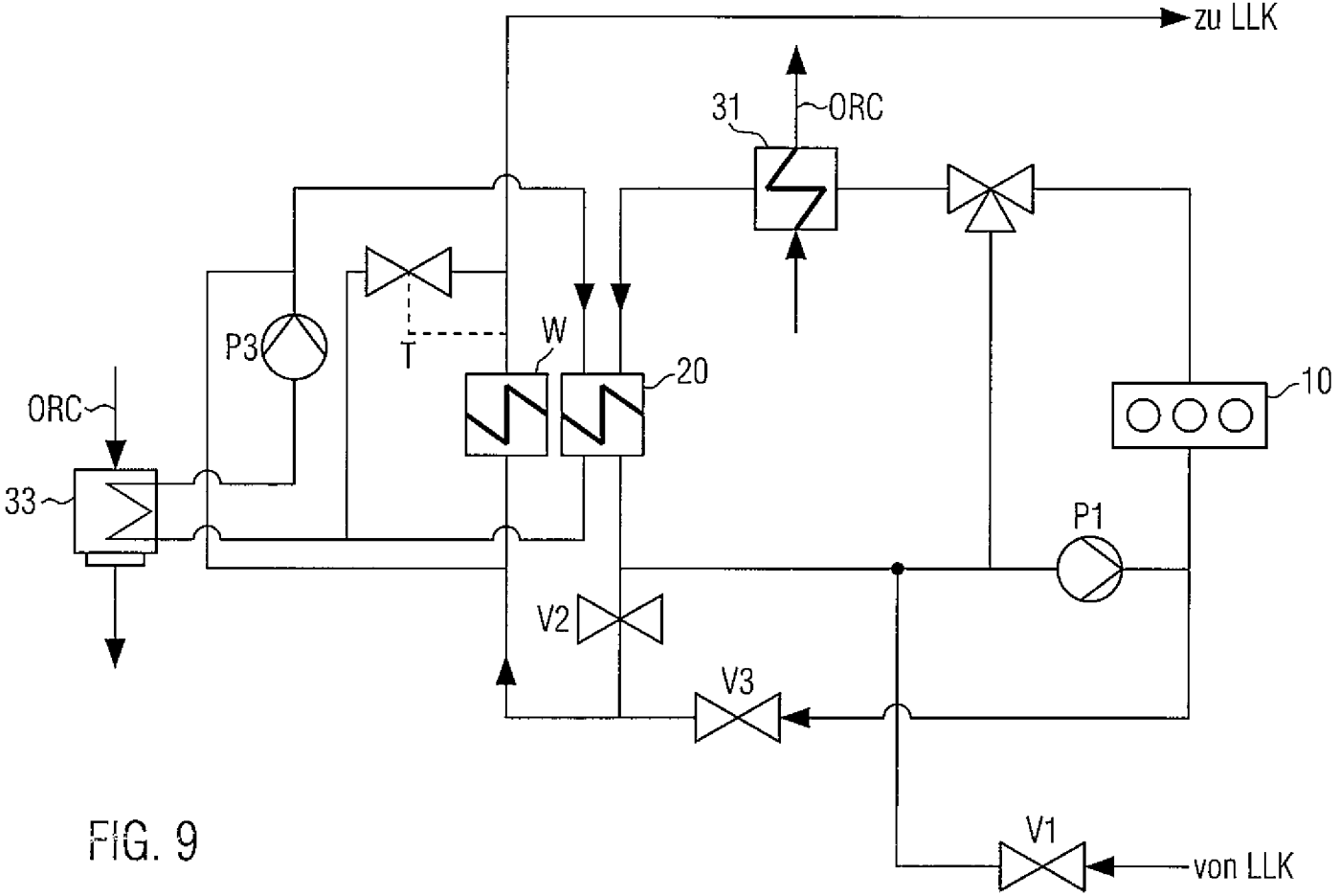
FIG. 9 shows an eighth embodiment of the system according to the invention.

The interconnection according to FIG. 6 can also be further developed as in the eighth embodiment shown in FIG. 9, so that the capacities of the further cooling circuit can be used for the ORC cooling.

Figure 10:
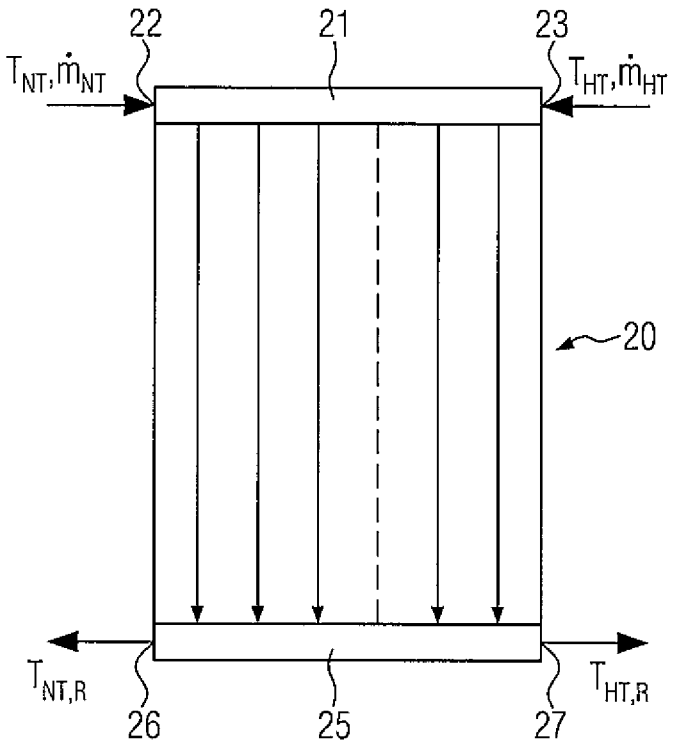
FIG. 10 illustrates the variability of the radiator surfaces.

The operation of the distribution of the mass flows in the third and fourth embodiments will be described below in conjunction with FIG. 10. Adjusting the proportions of the hot or cold radiator surface takes place automatically in this interconnection in dependence on the mass flows, which are passed through the 3-way valve 72 and 73 to the radiator. The greater the mass flow m $\dot{m}_H$ of the hot MKW or $m_k$ of the cold condenser circuit, the greater the respective proportion of the radiator surface. The underlying operating principle is that an equal pressure difference is established between flow and return. If, at a first connection, a first mass flow or volume flow into the radiator is increased, then in the first step this would result in a greater pressure loss in the passages of the radiator through which the first volume flow flows. However, since the channels are connected via the collector, the same pressure loss prevails over all channels, so that the volume flow increases through the channels through which the second mass flow flows. However, if the second mass flow remains constant, then the number of channels must be reduced, so that more area is available for the larger first mass flow and the pressure losses are adjusted accordingly.

Due to the separation of temperature levels, the available heat transfer surface of the radiator 20 is advantageously used in the best possible way. Compared to the (previously described) mixing of the temperatures of two partial flows significantly lower temperatures can be achieved on the cold side. This has advantages in operating an ORC, but also in all other applications where two temperature levels are to be recooled through a circuit, e.g. as it is the case in stationary engines for cooling the engine cooling water and the charge air. Due to the proposed interconnection, heat can be discharged to the environment at the greatest possible temperature difference, which leads to a reduction of the auxiliary energy requirement, and the lower-tempered volume flow is cooled to lower temperatures than when the two volume flows are mixed. The device can be provided as shown in a radiator but also by the connection of any number of radiators by means of pipelines.

Figure 11:
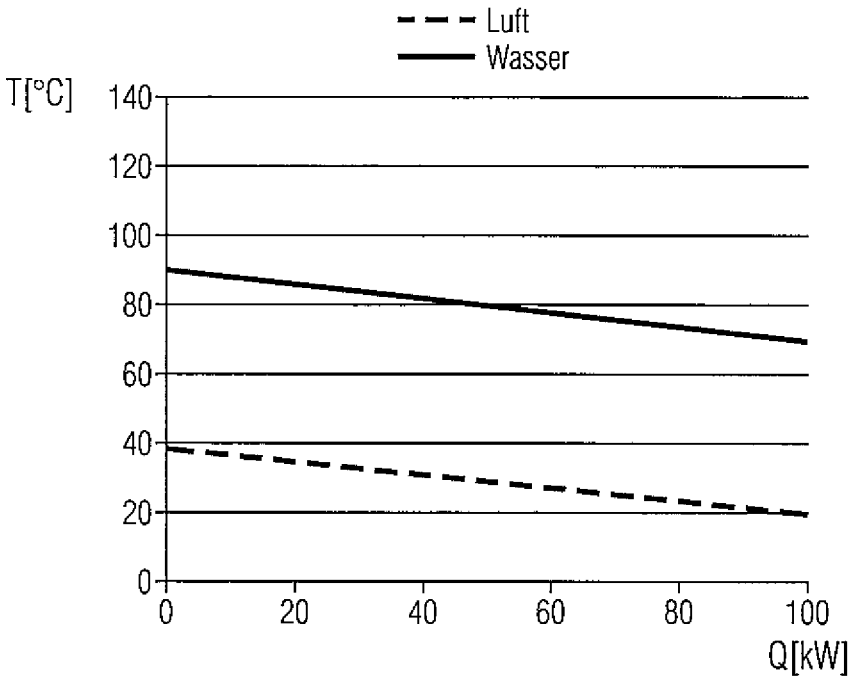
FIG. 11 is an exemplary illustration of the cooling of mixed cooling water in a T-Q diagram.
Figure 12:
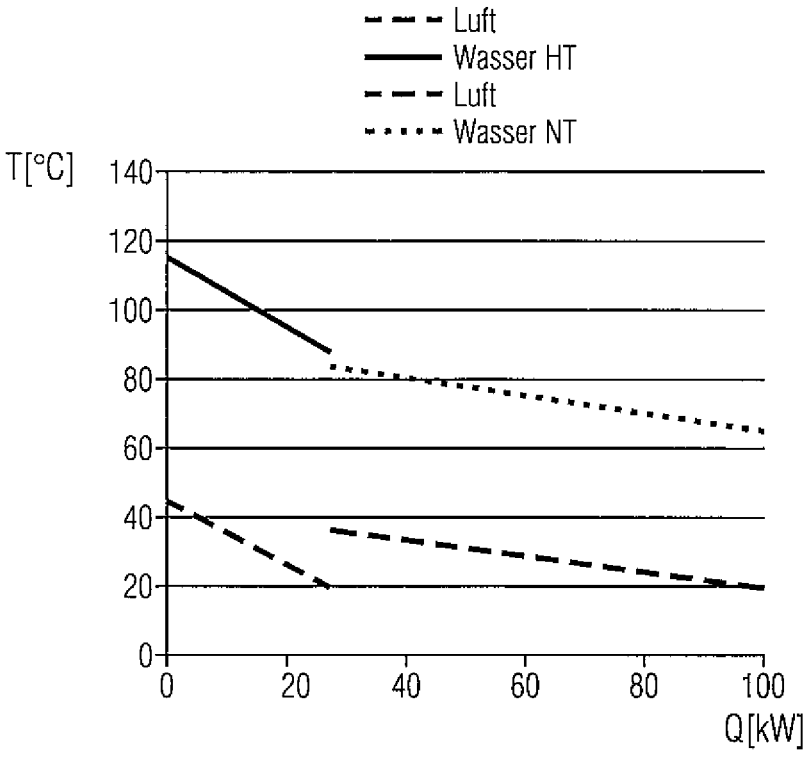
FIG. 12 is an exemplary illustration of the cooling of separated cooling water in a T-Q diagram.

FIGS. 11 and 12 explain the mode of operation and advantageousness of the interconnection according to the third and fourth embodiments in comparison with the second embodiment in T-Q diagrams (T: temperature; Q: heat flow).

FIG. 11 shows an example of the cooling of the water mass flow of 90° C., the hotter of the two heat sources allows a temperature of 115° C. It is achieved a recooling temperature of the water of 70° C.

When using two temperature stages, as illustrated in FIG. 12, the first mass flow enters the radiator at 115° C. and in this example is cooled down to 88° C., wherein this temperature is set when 20% of the entire mass flow flowing through the radiator is present at a high temperature level. As described above, the areas split according to the mass flow, and thus 20% of the surface are available for the heat transfer of the first, hot mass flow. If the heat flows are calculated, however, 27% of the total amount of heat is transmitted over this area. The remaining 73% of the heat is then transferred over the remaining 80% of the area, which is now possible at lower temperatures. Thus, this amount of heat can be transmitted with a flow temperature of hot water of 84° C. and a return temperature of 65° C., which means a lower by 5 K return temperature. This is accompanied by performance enhancement of the ORCs or improvement of heat transfer in other components (intercooler, etc.).

It is noted here that the described temperature and power values are only to be seen by way of example; by optimizing and adapting temperature limits, even further potential can be raised. An optimization takes into account the temperature as well as the influence of the mass flow on the heat transfer capacity/performance of a heat exchanger.

Figure 13:
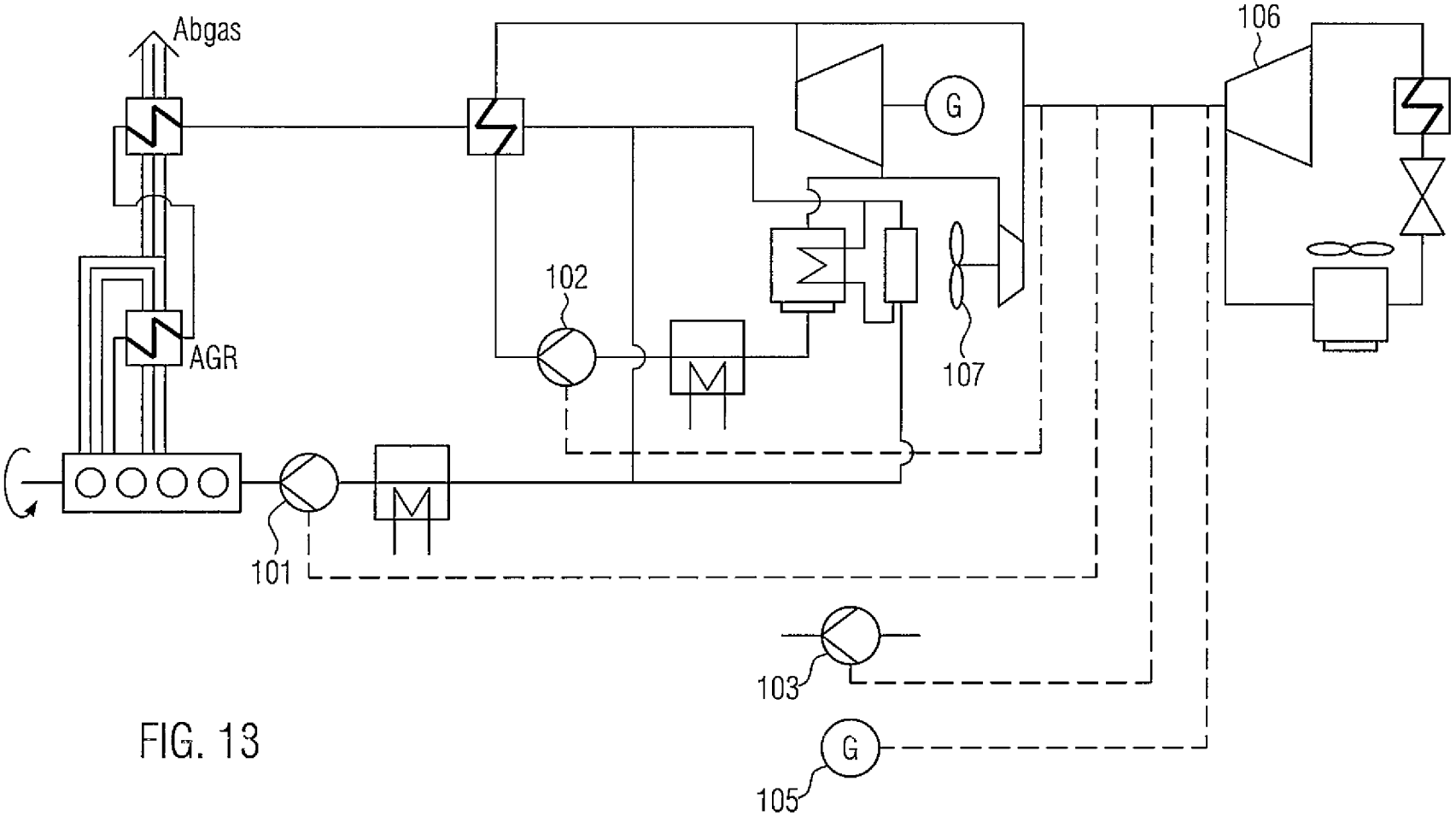
FIG. 13 illustrates various other synergies in the system of the invention.

The drive system can be further developed in view of further synergies described in connection with FIG. 13, and each of these can be used individually or in combination. The mechanical energy generated by the expansion device may be usable via a respective electrical, mechanical or hydraulic coupling for (a) driving a fan of the condenser 30 and/or a fan of the radiator; and/or (b) driving a circulation pump 101 in the engine cooling fluid circuit and/or a feed pump 102 of the thermodynamic cycle device and/or a circulation pump 103 in the condenser coolant circuit and/or a water pump and/or a hydraulic pump and/or an oil pump; and/or (c) driving an alternator 105 and/or a starter of the drive system; and/or (d) driving a refrigeration compressor 106 of an air conditioner. A partial flow of the vaporized working medium may be used to drive a fan of the condenser and/or a fan 107 of the radiator. This minimizes conversion losses. Furthermore, heat may be extracted from condensed working fluid and/or from the engine cooling fluid circuit for delivery to a heater.

The illustrated embodiments are merely exemplary and the full scope of the present invention is defined by the claims.

The invention claimed is:

1. A system for heat utilization, comprising:

a heat source; and a cooling device for discharging heat from the heat source;

wherein the cooling device comprises:

a radiator for transferring heat to a surrounding medium;

a thermodynamic cycle device having a working medium, an evaporator for evaporating the working medium by transferring heat of the heat source to the working medium, an expansion device for generating mechanical energy, and a condenser for condensing the working medium expanded in the expansion device;

a condenser coolant circuit for discharging heat from the condenser of the thermodynamic cycle device via the radiator; and a heat source coolant circuit, wherein a first branch of the heat source coolant circuit passes through the evaporator for transferring heat to the working fluid, wherein the heat source coolant circuit in a flow direction of a cooling fluid upstream of the evaporator comprises a first branch-off into a second branch of the heat source coolant circuit for bypassing the evaporator and a merging of the second branch with the first branch downstream of the evaporator, the second branch comprising a first valve, and wherein the heat source coolant circuit in the flow direction of the cooling fluid upstream of the evaporator comprises a second branch-off into a third branch of the heat source coolant circuit, and wherein the third branch is configured to move cooling fluid through the radiator and back into the first branch.

2. The system according to claim 1, wherein the heat source comprises (i) a power process device comprising one of an internal combustion engine, a gas turbine, or a Stirling engine, (ii) a boiler comprising a biomass burner, or (iii) a fuel cell.

3. The system according to claim 1, further comprising at least one selected from the group consisting of (i) the heat source coolant circuit includes a first pump, (ii) the thermodynamic cycle device includes a second pump for pumping the working medium, and (iii) the condenser coolant circuit includes a third pump.

4. The system according to claim 1, wherein the heat source coolant circuit comprises, in the flow direction of the cooling fluid downstream of the evaporator, a third branch-off into a fourth branch of the heat source coolant circuit, and wherein the fourth branch is configured to move cooling fluid through the radiator and back into the first branch, wherein the fourth branch merges into the third branch.

5. The system according to claim 4, wherein at least one selected from the group consisting of (i) the third branch comprises a third valve-comprising a three-way valve and (ii) the fourth branch comprises a fifth pump.

6. The system of claim 1, wherein the heat source coolant circuit in the flow direction of the cooling fluid upstream of the radiator comprises a merging of at least one selected from the group consisting of the third branch and the fourth branch with the condenser coolant circuit.

7. The system of claim 1, wherein the radiator has an inlet collector, an outlet collector, and intermediate channels interconnecting respective opposite portions of the inlet collector and the outlet collector, and wherein an inlet of the condenser cooling fluid cycle into the inlet collector and an inlet of at least one selected from the group consisting of the third and fourth branch of the heat source coolant circuit into the inlet collector are spaced from each other at respective end portions of the inlet collector, and wherein an outlet of the condenser coolant circuit from the outlet collector and an outlet of at least one selected from the group consisting of the third and fourth branch of the heat source coolant circuit from the outlet collector are spaced from each other and arranged at respective end portions of the outlet collector, wherein the inlet and outlet of the condenser coolant circuit and the heat source coolant circuit are each arranged at respective opposite areas of the inlet collector and the outlet collector.

8. The system according to claim 1, wherein at least one selected from the group consisting of (i) the second branch-off comprises a second valve comprising a three-way valve, and (ii) the third branch comprises a fourth pump.

9. The system according to claim 1, wherein the cooling device further comprises at least one heat exchanger for transferring heat in exhaust gas of the heat source to the heat source coolant circuit.

10. The system according to claim 1, further comprising a generator configured to convert the mechanical energy generated by the expansion device into electrical energy.

11. The system according to claim 1, wherein the mechanical energy generated by the expansion device is used via a respective electrical, mechanical or hydraulic coupling for at least one selected from the group consisting of:

(a) driving at least one selected from the group consisting of a fan of the condenser and a fan of the radiator;

(b) driving at least one selected from the group consisting of a circulation pump in the heat source coolant circuit, a feed pump of the thermodynamic cycle device, a circulation pump in the condenser coolant circuit, a water pump, a hydraulic pump and an oil pump;

(c) driving at least one selected from the group consisting of a generator and a starter of the drive system;

(d) driving a refrigeration compressor of an air conditioner; and (e) coupling the mechanical energy generated by the expansion device in a drive train of the heat source directly to a drive shaft, wherein the heat source comprises a power process device comprising an internal combustion engine.

12. The system according to claim 1, further comprising at least one selected from the group consisting of (i) using a partial flow of the evaporated working medium to drive at least one selected from the group consisting of a fan of the condenser, a fan of the radiator and a refrigeration compressor; and (ii) coupling out heat from at least one selected from the group consisting of the condensed working medium and the heat source coolant circuit for feeding into a heating device.

13. The system according to claim 1, further comprising: a second cooling circuit with a second heat exchanger, wherein the second heat exchanger is connected in series with or parallel to the radiator.

14. The system according to claim 1, wherein the radiator is an air cooler and the surrounding medium is air.

15. The system according to claim 1, wherein the thermodynamic cycle device comprises an Organic Rankine Cycle (ORC) device.

16. A method for discharging heat from a heat source using a cooling device, wherein the cooling device comprises a radiator, a thermodynamic cycle device, a working medium, an evaporator, an expansion device and a condenser and a condenser coolant circuit, and wherein the method comprises:

transferring heat to a surrounding medium with the radiator;

vaporizing the working medium with the evaporator by transferring heat from the heat source to the working medium;

generating mechanical energy using the expansion device;

condensing the working medium expanded in the expansion device using the condenser;

discharging heat from the condenser of the thermodynamic cycle device via the radiator;

passing a first branch of a heat source coolant circuit through the evaporator to transfer heat to the working medium;

first branching-off of a cooling fluid in the heat source coolant circuit in a flow direction upstream of the evaporator into a second branch of the heat source coolant circuit for bypassing the evaporator;

merging the second branch with the first branch downstream the evaporator; and further comprising at least one selected from the group consisting of:

(i) second branching-off of the cooling fluid upstream of the evaporator into a third branch of the heat source coolant circuit, the third branch passing cooling fluid through the radiator and back into the first branch, and (ii) third branching-off of the cooling fluid downstream of the evaporator into a fourth branch of the heat source coolant circuit, the fourth branch passing cooling fluid through the radiator and back into the first branch, wherein the radiator has an inlet collector, an outlet collector, and intermediate channels interconnecting respective opposite portions of the inlet collector and the outlet collector, and wherein an inlet of the condenser cooling fluid cycle into the inlet collector and an inlet of at least one selected from the group consisting of the third branch and the fourth branch of the heat source coolant circuit into the inlet collector are spaced from each other at respective end portions of the inlet collector, and wherein an outlet of the condenser coolant circuit from the outlet collector and an outlet of at least one selected from the group consisting of the third branch and the fourth branch of the heat source coolant circuit from the outlet collector, respectively, are spaced from each other and arranged at respective end portions of the outlet collector, wherein the inlet and outlet of the condenser coolant circuit and of the heat source coolant circuit are arranged at respective opposite portions of the inlet and the outlet collector.

17. The method according to claim 16, wherein the radiator is an air cooler and the surrounding medium is air.

18. The method according to claim 16, wherein the thermodynamic cycle device comprises an Organic Rankine Cycle (ORC) device.

* * * * *